US008555689B2

(12) United States Patent
Hollinger et al.

(10) Patent No.: US 8,555,689 B2
(45) Date of Patent: Oct. 15, 2013

(54) METHOD FOR THE WET DRAWING OF STEEL CABLES FOR REINFORCING TIRES

(75) Inventors: Sébastien Hollinger, Clermont-Ferrand (FR); Christelle Genin, Saint-Jorioz (FR); David Monin, Paris (FR)

(73) Assignees: Michelin Recherche et Technique S.A., Granges-Paccot (CH); Compagnie Generale des Etablissements Michelin, Clermont-Ferrand (FR)

( * ) Notice: Subject to any disclaimer, the term of this patent is extended or adjusted under 35 U.S.C. 154(b) by 877 days.

(21) Appl. No.: 12/529,885

(22) PCT Filed: Mar. 6, 2008

(86) PCT No.: PCT/EP2008/001782
§ 371 (c)(1),
(2), (4) Date: Mar. 22, 2010

(87) PCT Pub. No.: WO2008/113481
PCT Pub. Date: Sep. 25, 2008

(65) Prior Publication Data

US 2010/0170624 A1 Jul. 8, 2010

(30) Foreign Application Priority Data

Mar. 8, 2007 (FR) ..... 07 01681

(51) Int. Cl.
*B21C 1/00* (2006.01)
*B21B 45/02* (2006.01)

(52) U.S. Cl.
USPC ..... 72/274; 72/42

(58) Field of Classification Search
USPC ..... 72/41, 42, 274, 278, 282; 504/485, 486; 508/485, 486
See application file for complete search history.

(56) References Cited

U.S. PATENT DOCUMENTS

| | | | | | |
|---|---|---|---|---|---|
| 4,404,827 | A | * | 9/1983 | Van den Sype | 72/41 |
| 4,404,828 | A | * | 9/1983 | Blachford | 72/42 |
| 4,812,248 | A | * | 3/1989 | Marwick | 508/486 |
| 4,869,764 | A | * | 9/1989 | Marwick | 156/196 |
| 5,173,341 | A | * | 12/1992 | Shiratori et al. | 427/434.6 |
| 5,650,382 | A | * | 7/1997 | Deruyck et al. | 508/367 |
| 5,676,005 | A | * | 10/1997 | Balliett | 72/42 |
| 6,194,357 | B1 | * | 2/2001 | Murata et al. | 508/113 |
| 6,318,139 | B1 | * | 11/2001 | Ishikura et al. | 72/42 |
| 7,008,909 | B2 | * | 3/2006 | Burgo et al. | 508/463 |
| 2004/0072702 | A1 | * | 4/2004 | Raison et al. | 508/435 |

FOREIGN PATENT DOCUMENTS

| | | |
|---|---|---|
| EP | 0 276 568 | 8/1988 |
| FR | 2 369 336 | 5/1978 |

* cited by examiner

*Primary Examiner* — Dana Ross
*Assistant Examiner* — Lawrence Averick
(74) *Attorney, Agent, or Firm* — Cozen O'Connor

(57) ABSTRACT

A process for the wet drawing of a steel wire intended for reinforcing a pneumatic tire. The process starts from a steel wire having a diameter greater than 0.6 mm. The wire is drawn through a series of dies of decreasing diameter, in the presence of a lubricant composition that is in the form of an aqueous dispersion, down to a predetermined final diameter of less than 0.5 mm. The aqueous dispersion comprises solid particles of an ester of a fatty acid comprising from 5 to 40 carbon atoms.

26 Claims, No Drawings

METHOD FOR THE WET DRAWING OF STEEL CABLES FOR REINFORCING TIRES

RELATED APPLICATIONS

This is a U.S. national stage under 35 U.S.C. §371 of application Ser. No. PCT/EP2008/001782, filed on Mar. 6, 2008.

This application claims the priority of French application no. 07/01681 filed Mar. 8, 2009, the entire content of which is hereby incorporated be reference.

FIELD OF THE INVENTION

The present invention relates to processes for drawing metal wires and also to the use of aqueous-based lubricants in such drawing processes.

Lubricants can be used that are in the form of aqueous dispersions for the wet drawing of steel wires intended for reinforcing pneumatic tires (steel wires of the "Steelcord" type).

BACKGROUND OF THE INVENTION

The drawing of Steelcord steel wires through dies is carried out under extremely severe temperature and pressure conditions due to significant friction that then develops between the wire and the dies. This results in rapid wearing of the die surface and of that of the wire, risks of breaking and appearance of surface defects on the wire. A too rapid increase in the diameter of the die and therefore of the drawn wire is unacceptable from an industrial viewpoint.

To overcome the above problems, or at least minimize them, it is known to use oily or aqueous type lubricants.

Under the most extreme conditions, aqueous lubricants are generally preferred due to their superior metal-cooling capacity. Other advantages they have are being easy to use, not very polluting and more economical.

The most commonly used commercial drawing lubricants are aqueous emulsions (see, for example, document FR 1 037 447) composed of different fatty constituents in liquid form put into emulsion in the aqueous phase via a combination of surfactants. Various additives may be dissolved in the aqueous or fatty phase.

Lubricants in the form of an aqueous dispersion, based on a solid fatty phase (or "wax") dispersed in the aqueous phase, generally stabilized by a combination of surfactants, may also be used. Aqueous dispersions comprising, in particular, solid particles of waxes based on bisamides such as ethylene bis (stearamide) (abbreviated hereinbelow to "EBS") are also widespread; they are known for the cold working of metals, in particular for rolling (see, for example, documents WO 02/062931 or US 2004/072702, U.S. Pat. No. 4,481,038).

Obtaining more efficient lubrication is a constant concern in the field of drawing Steelcord steel wires, in order to achieve, in particular, at least one of the following industrial objectives:

- higher productivity, for example a faster drawing rate;
- a lower die replacement frequency;
- less breakage of wires when they are being drawn; and
- the possibility of drawing harder steels, having a higher carbon content, under production conditions similar to those used for the drawing of less hard steels.

SUMMARY OF THE INVENTION

The Applicants have discovered, during their research, a novel aqueous dispersion that has a simple formulation compared to those from the prior art which makes it possible to obtain a more efficient lubrication that satisfies the above objectives.

An embodiment of the present invention uses as a lubricant composition in a wet drawing process, in order to obtain a steel wire intended for reinforcing a pneumatic tire (hereinafter also denoted by "Steelcord steel wire"), an aqueous dispersion comprising solid particles of an ester of a fatty acid comprising from 5 to 40 carbon atoms.

Such a dispersion makes it possible to not only improve the lubrication performances under extreme speed and temperature conditions, in particular in terms of wear and friction, especially compared to EBS-based aqueous dispersions, but also to obtain a better stability of the performance compared to aqueous emulsions by limiting the possible interactions with the surface of the wire and its optional coating, and thus the change in the chemical composition of the drawing bath during its use (problem referred to as "running-in of the bath").

One aspect of the invention relates to a wet drawing process in order to obtain a Steelcord steel wire, said process comprising the following steps:

starting from a steel wire having a diameter greater than 0.6 mm; and drawing said wire through a series of dies of decreasing diameter, in the presence of a lubricant composition that is in the form of an aqueous dispersion, down to a predetermined final diameter of less than 0.5 mm, wherein said aqueous dispersion comprises solid particles of an ester of a fatty acid comprising from 5 to 40 carbon atoms.

Another aspect of the invention relates to a process for manufacturing a pneumatic tire comprising rubber and at least one steel reinforcing element, said process comprising the following steps:

- starting from a steel wire having a diameter greater than 0.6 mm;
- drawing said wire through a series of dies of decreasing diameter, in the presence of a lubricant composition that is in the form of an aqueous dispersion comprising solid particles of an ester of a fatty acid comprising from 5 to 40 carbon atoms until a fine wire having a diameter of less than 0.5 mm is obtained;
- optionally assembling a plurality of fine wires thus obtained in order to obtain an assembly of fine wires;
- incorporating said fine wire and/or said assembly as a metallic reinforcing element, as is or incorporated beforehand into the rubber in the uncured state, into the structure of pneumatic tire in the process of being manufactured;
- carrying out the curing of the pneumatic tire once its structure is completed.

I. DETAILED DESCRIPTION

In the present description, unless expressly indicated otherwise, all the percentages (%) indicated are % by weight.

I-1. Lubricant Composition

The lubricant composition used in accordance with the invention therefore has the main feature of being an aqueous dispersion and of comprising solid particles of an ester of a fatty acid comprising from 5 to 40 carbon atoms. It may comprise various additives, in particular an amphiphilic compound such as a surfactant and/or an extreme pressure additive.

a) Fatty Acid Ester

It is recalled that the term "fatty acid" should be understood to mean, by definition, an aliphatic carboxylic acid; this fatty acid therefore comprises from 5 to 40 carbon atoms (the carbon atom of the carboxyl group —COOH being included), preferably from 6 to 24 carbon atoms; it is more preferably a long-chain fatty acid having 14 to 22, in particular 16 to 22, carbon atoms. Such definitions should also be understood to mean mixtures of the corresponding fatty acids.

The term "aqueous dispersion" should be understood to mean a liquid dispersion, the liquid of which is generally water alone. It can however be envisaged to combine therewith minimal amounts (preferably less than 10% by weight, or even less than 1% by weight) of solvents, the latter preferably being of low volatility.

The term "solid particles" is understood to mean particles which are solid at ambient temperature (23° C.), preferably over a temperature range that extends from 23° C. to at least 40° C., more preferably from 23° C. to at least 50° C.; they may have a melting point below 200° C., in particular below 135° C., for example below 70° C. The melting point may be greater than or equal to 60° C. The fatty acid ester may be chosen, in particular, as a function of the melting point, which is generally above the temperature at which the drawing process is carried out. It is not however excluded that the temperature exceeds this melting point very locally, such a phenomenon does not affect the invention.

The ester may be any type of ester, for example a diester or triester, in particular an ester that derives from a diol (or glycol), from a polyol or from a mixture of such alcohols. By way of examples of diols or polyols, mention may be made of alkylene glycols such as ethylene glycol or propylene glycol, or else glycerol.

According to one preferred embodiment of the invention, the ester corresponds to the formula (I)

$$[R—COO—]_x\text{-}A\text{-}[\text{-}OH]_y \quad \text{(I):}$$

in which:

R is a linear or branched, saturated or unsaturated hydrocarbon group (corresponding of course to that of the formula R—COOH of the corresponding fatty acid);

A is a hydrocarbon group, optionally interrupted by one or more heteroatoms, of valency x+y;

x is an average number from 1 to 5;

y is an average number from 0 to 5; and x+y varies from 1 to 10, preferably from 2 to 5.

In the present application, an average number may denote an integer or a decimal number.

When y is different from 0, this means that it is a partial ester. When y is equal to 0, this means that it is a completely esterified compound. For example, when x+y=2, y=0 and x=2, it is then a diester (completely esterified).

According to one preferred embodiment of the invention, A is a divalent group (x+y=2; $A—(—OH)_{x+y}$ is then a diol), and y is equal to 0.

Preferably, the ester is a diester corresponding to the formula (II):

$$R^1—CO—O\text{-}A\text{-}O—CO—R^2 \quad \text{(II)}$$

in which $R^1$ and $R^2$, which are identical or different, are linear or branched, saturated or unsaturated, preferably saturated (i.e. alkyl groups) hydrocarbon groups comprising from 4 to 39, preferably from 5 to 23, in particular from 13 to 21, more particularly from 15 to 21, carbon atoms; A having the definition given above for formula (I).

In the formula (II) above, the divalent group A may in particular correspond to the formula:

$$—(CH_2)_z—[EO]_m—[PO]_{m'}—(CH_2)_{z'}—$$

in which:

z and z', which are identical or different, are integers from 1 to 10;

EO is an optional ethylene oxide group;

PO is an optional propylene oxide group;

m and m', which are identical or different, are average numbers (integers or decimal numbers) within a range from 0 to 100, preferably from 0 to 10.

When EO and/or PO groups are present, the diol compound of formula $A\text{-}(\text{-}OH)_2$ from which the ester derives may be a product of (poly)ethoxylation and/or of (poly)propoxylation, or of condensation of ethylene glycol and/or of propylene glycol.

Preferably, the A group does not comprise EO and/or PO groups, and it is then preferably an alkylene group; such a definition corresponds, in particular, to a diester of specific formula (III):

$$R^1—CO—O—(CH_2)_{z''}—O—CO—R^2 \quad \text{(III)}$$

in which A is an alkylene group $[(CH_2)_{z''}]$ comprising (z" number) from 1 to 15, preferably from 1 to 10, carbon atoms; A is especially chosen from the group formed by methylene, ethylene, propylene or butylene groups, and mixtures of these groups; $R^1$ and $R^2$ have the definitions given above for formula (II).

The fatty acids and hydrocarbon (preferably alkyl) groups R, $R^1$ and $R^2$, described previously are well known. In general they are derivatives of plant oils. They may be present as mixtures. When they are mixtures, all the groups come under the definition, irrespective of the number of carbon atoms, when the group (or the corresponding acid) that is in the majority by weight (relative, preferably absolute, majority preferably of at least 75%) corresponds to the definition. It is common to reduce the name of the group (or of the corresponding acid) to the majority group (or acid).

According to one particular and advantageous embodiment of the invention, the diester of formula (III) above preferably corresponds to the more specific formula (IV):

$$H_3C—(CH_2)_n—CO—O—(CH_2)_{z''}—O—CO—(CH_2)_{n'}—CH_3 \quad \text{(IV)}$$

in which:

z" is an integer from 1 to 10, preferably from 1 to 4;

n and n', which are identical or different, are integers from 12 to 20, preferably from 14 to 20.

According to one preferred embodiment, the invention is carried out with a saturated fatty acid, in particular a $C_6$-$C_{24}$ saturated fatty acid. As examples of saturated fatty acids mention will be made of those chosen from the group formed by caproic ($C_6$) acid, caprylic ($C_8$) acid, capric ($C_{10}$) acid, lauric ($C_{12}$) acid, myristic ($C_{14}$) acid, palmitic ($C_{16}$) acid, stearic ($C_{18}$) acid, isostearic ($C_{18}$) acid, behenic ($C_{22}$) acid and lignoceric ($C_{24}$) acid and mixtures of these acids.

Use is particularly made of the saturated fatty acids chosen from the group formed by myristic ($C_{14}$) acid, palmitic ($C_{16}$) acid, stearic ($C_{18}$) acid, isostearic ($C_{18}$) acid and behenic ($C_{22}$) acid and mixtures of these acids.

Particularly preferably, the ester used is a diester of stearic acid and of a diol, in particular of an alkylene glycol such as ethylene glycol.

The use of ethylene glycol distearate has proved particularly advantageous. The expression "compound based on EGDS" is understood, in the present application, to mean a compound or a composition comprising at least 75% by weight of ethylene glycol distearate, and optionally other compounds, for example ethylene glycol monostearate ("EGMS"). Except where mentioned otherwise or specified in greater detail as regards the presence of other compounds, the expression "ethylene glycol distearate" or the acronym EGDS will denote, in the present application, a compound based on EGDS.

Ethylene glycol distearate is a well-known, commercially available compound that corresponds to the particular formula (V) below:

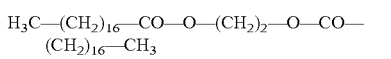

$$H_3C—(CH_2)_{16}—CO—O—(CH_2)_2—O—CO—(CH_2)_{16}—CH_3 \quad (V)$$

It is especially known for its use in crystalline form as a pearlescent agent and/or viscosity modifier in cosmetic formulations, or as a bulking additive in thermoplastics, as a lubricant for increasing moulding rates. It has also been described as an engine oil lubricant in document U.S. Pat. No. 2,039,111.

In the drawing process according to the invention, the content of solid ester particles in the aqueous dispersion is preferably between 0.05 and 6%, more preferably within a range of 0.2 to 3%, for example within a range of 0.5 to 1.5%. The initial aqueous dispersion, when it is available in a more concentrated form (typically greater than 6%), is advantageously diluted in accordance with the preferred percentages indicated above.

The ester particles preferably have a particle size distribution with at least 90% by weight of the particles having a size between 0.1 and 50 μm. The particle size distribution may, for example, be determined using a light-scattering or laser-diffraction particle size analyser (for example the Horiba LA-910 laser-type analyser).

The particle size may especially be fine (with a weight-average size between 0.5 and 10 μm) or coarser (with a weight-average size between 10 and 50 μm). It is not excluded that the particle size distribution has a bimodal population, with a fine population and a coarser population. The particles may especially have a particle size distribution:

- with more than 50 wt % of the particles having a size between 0.5 and 10 μm, or
- with more than 50 wt % of the particles having a size between 10 and 30 μm, preferably between 10 and 20 μm.

A very coarse particle size may especially be difficult to stabilize. A very fine particle size may be restrictive to obtain.

The present invention also applies to the cases where the solid fatty acid ester particles previously described are used in combination with other particles, whether they are solid or non-solid, capable of completing the lubricating base. In such a case, the solid fatty acid ester particles preferably make up more than 50%, more preferably more than 75%, for example more than 90% of the solid wax particles that form the lubricating base of the lubricant composition used in the drawing process of the invention. It is however preferred that these solid fatty acid ester particles constitute all of the solid wax particles that form the lubricating base.

b) Amphiphilic Compound

According to one preferred embodiment, combined with the fatty acid ester described previously is an amphiphilic compound such as a surfactant that makes it possible to improve the dispersion in water of the solid ester particles. Such a compound may help to stabilize the solid particles (preventing, for example, settling which would affect the effectiveness or would require additional stirring means that could interfere with the forming process). It may also help to optimize the effectiveness of the lubrication.

The amphiphilic compound is preferably water soluble. The term "water-soluble compound" is understood to mean a compound that is soluble in an aqueous medium, at 23° C., at a concentration of 1 wt %.

Preferably, the amphiphilic compound is a surfactant, in particular chosen from the group formed by anionic, cationic, amphoteric, zwitterionic or non-ionic surfactants and mixtures of such surfactants. But it is not excluded to use more complex compounds such as block polymers other than alkylene oxide block copolymers (the latter are conventionally classified as surfactants) or comb copolymers. Surfactants are generally amphiphilic compounds of relatively low molecular weight (for example of less than 1000 g/mol) and/or polyalkoxylates.

By way of example of anionic surfactants, mention may be made, with no intention of being limited thereto, of:

- alkylsulphonic acids, arylsulphonic acids, optionally substituted by one or more hydrocarbon groups, and of which the acid functional group is partially or completely salified, such as $C_8$-$C_{50}$, more particularly $C_8$-$C_{30}$, preferably $C_{10}$-$C_{22}$ alkylsulphonic acids, benzenesulphonic acids, naphthalenesulphonic acids, substituted by one to three $C_1$-$C_{30}$, preferably $C_4$-$C_{16}$, alkyl groups and/or $C_2$-$C_{30}$, preferably $C_4$-$C_{16}$, alkenyl groups;
- monoesters or diesters of alkylsulphosuccinic acids, of which the linear or branched alkyl part is optionally substituted by one or more hydroxylated and/or alkoxylated (preferably ethoxylated, propoxylated or ethopropoxylated) linear or branched $C_2$-$C_4$ groups;
- phosphate esters chosen more particularly from those comprising at least one linear or branched, saturated, unsaturated or aromatic hydrocarbon group comprising 8 to 40, preferably 10 to 30, carbon atoms, optionally substituted by at least one alkoxylated (for example ethoxylated, propoxylated, ethopropoxylated) group. Moreover, they comprise at least one monoesterified or diesterified phosphate ester group so that it is possible to have one or two free, or partially or completely salified, acid groups. The preferred phosphate esters are of the type of monoesters and diesters of phosphoric acid and of alkoxylated (ethoxylated and/or propoxylated) mono-, di- or tristyrylphenol, or of alkoxylated (ethoxylated and/or propoxylated) mono-, di- or trialkylphenol, optionally substituted by one to four alkyl groups; of phosphoric acid and of an alkoxylated (ethoxylated or ethopropoxylated) $C_8$-$C_{30}$, preferably $C_{10}$-$C_{22}$, alcohol; of phosphoric acid and of a non-alkoxylated $C_3$-$C_{22}$, preferably $C_{10}$-$C_{22}$, alcohol;
- sulphate esters obtained from saturated or aromatic alcohols, optionally substituted by one or more alkoxylated (ethoxylated, propoxylated, ethopropoxylated) groups, and for which the sulphate functional groups are present in the free acid form, or are partially or completely neutralized. By way of example, mention may be made of the sulphate esters obtained more particularly from saturated or unsaturated $C_8$-$C_{20}$ alcohols, which may comprise 1 to 8 alkoxylated (ethoxylated, propoxylated, ethopropoxylated) units; the sulphate esters obtained from polyalkoxylated phenol, substituted by 1 to 3 saturated or unsaturated $C_2$-$C_{30}$ hydroxycarbon-based groups, and in which the number of alkoxylated units is between 2 and 40; the sulphate esters obtained from polyalkoxylated mono-, di- or tristyrylphenol in which the number of alkoxylated units varies from 2 to 40.

The anionic surfactants may be in acid form (they are potentially anionic), or in a partially or completely salified form, with a counterion. The counterion may be an alkali metal, such as sodium or potassium, an alkaline-earth metal, such as calcium, or else an ammonium ion of formula $N(R)_4^+$ in which the R groups, being identical or different, represent a hydrogen atom or a $C_1$-$C_4$ alkyl radical optionally substituted by an oxygen atom.

By way of example of cationic surfactants, mention may be made of optionally polyalkoxylated quaternary fatty amines.

By way of example of zwitterionic or amphoteric surfactants, mention may be made of betaines (especially alkyldimethyl betaines, and alkylamidoalkyl betaines such as alkylamidopropyldimethyl betaines), amine oxides (especially alkyldimethylamine oxides, and alkylamidoalkylamine oxides such as alkylamidopropyldimethylamine oxides), sultaines, imidazoline derivatives, and amphopropionates.

By way of example of non-ionic surfactants, mention may be made of:

- polyalkoxylated (ethoxylated, propoxylated, ethopropoxylated) phenols substituted by at least one $C_4$-$C_{20}$, preferably $C_4$-$C_{12}$, alkyl radical or substituted by at least one alkylaryl radical of which the alkyl part is a $C_1$-$C_6$. More particularly, the total number of alkoxylated units is between 2 and 100. By way of example, mention may be made of polyalkoxylated mono-, di- or tri(phenylethyl)phenols, or polyalkoxylated nonylphenols. Among the ethoxylated and/or propoxylated di- or tristyrylphenols, mention may be made of ethoxylated di(1-phenylethyl)phenol, containing 10 oxyethylenated units, ethoxylated di(1-phenylethyl)phenol, containing 7 oxyethylenated units, sulphated ethoxylated di(1-phenylethyl)phenol, containing 7 oxyethylenated units, ethoxylated tri(1-phenylethyl)phenol, containing 8 oxyethylenated units, ethoxylated tri(1-phenylethyl)phenol, containing 16 oxyethylenated units, sulphated ethoxylated tri(1-phenylethyl)phenol, containing 16 oxyethylenated units, ethoxylated tri(1-phenylethyl)phenol, containing 20 oxyethylenated units and phosphated ethoxylated tri(1-phenylethyl)phenol, containing 16 oxyethylenated units;
- optionally polyalkoxylated (ethoxylated, propoxylated, ethopropoxylated) $C_6$-$C_{22}$ fatty acids or alcohols. In the case where they are present, the number of alkoxylated units is between 1 and 60:
- polyalkoxylated (ethoxylated, propoxylated, ethopropoxylated) triglycerides of plant or animal origin. Thus, triglycerides derived from lard, tallow, ground nut oil, butter oil, cottonseed oil, linseed oil, olive oil, palm oil, grapeseed oil, fish oil, soybean oil, castor oil, rapeseed oil, copra oil or coconut oil, and comprising a total number of alkoxylated units between 1 and 60, are suitable. The term "ethoxylated triglyceride" is directed both towards the products obtained by ethoxylation of a triglyceride with ethylene oxide and towards those obtained by transesterification of a triglyceride with a polyethylene glycol;
- polyalkoxylated (for example ethoxylated, propoxylated, ethopropoxylated) sorbitan esters;
- ethylene oxide/$C_3$-$C_{10}$ alkylene oxide block copolymers; and
- optionally polyalkoxylated (for example ethoxylated, propoxylated, ethopropoxylated) fatty amines, especially $C_5$-$C_{22}$ fatty amines. In the case where they are present, the number of alkoxylated units may be between 1 and 60.

The following may especially be incorporated into the composition, alone or as mixtures or combinations:

- non-ionic surfactants of fatty acid or polyalkoxylated (for example ethoxylated, propoxylated or ethopropoxylated) fatty acid type (Alkamuls® family from Rhodia, as examples of ethoxylated castor oils: Alkamuls® OR36, Alkamuls® RC, Alkamuls® R81, Alkamuls® 696);
- non-ionic surfactants of ethoxylated or ethoxypropoxylated alcohol or polyalkylene glycol type, such as the family of Rhodasurf® products from Rhodia, by way of example Rhodasurf® LA/30, Rhodasurf® IDS, Rhodasurf® 860P;
- ethoxylated or ethoxypropoxylated aromatic non-ionic surfactants, by way of example the family of Igepal® products from Rhodia,
- surfactants of the ethoxy or ethoxypropoxylated block copolymer type, for example the family of Antarox® products from Rhodia, such as Antarox® B848, Antarox® PLG 254, Antarox® PL 122, Antarox® SC138;
- anionic surfactants, such as sulphonates, aliphatic sulphonates, sulphonates bearing ester or amide groups such as isothionates (sulphoesters), taurates (sulphoamides), sulphosuccinates, sulphosuccinamates, or else sulphonates that do not bear amide or ester groups such as alkyldiphenyloxide disulphonates, alkyl naphthalene sulphonates, naphthalene/formaldehyde sulphonates with, for example, dodecyl benzene sulphonate (family of Rhodacal® products from Rhodia, such as for example Rhodacal® 60 BE);
- phosphate esters, for example the family of Rhodafac® products from Rhodia such as Rhodafac® PA 17, Rhodafac® MB;
- compounds based on styrylphenol such as distyryiphenols, tristyrylphenols, which may be ethoxylated or ethoxypropoxylated, phosphated, or sulphated, for example the family of Soprophor® products from Rhodia such as Soprophor® DSS7, Soprophor® BSU, Soprophor 3D33, Soprophor 4D384, Soprophor® 796P;
- surfactants derived from terpenes, for example the family of Rhodoclean® products from Rhodia; and
- ethoxylated fatty amines, for example the family of Rhodameen® products from Rhodia.

According to one preferred embodiment, a non-ionic surfactant or a mixture of such non-ionic surfactants is used in order to minimize, in particular, the possible interactions with the water of the dispersion and its optional parasite ions.

More preferably, the non-ionic surfactant is chosen from the group formed by polyalkoxylated phenols, optionally polyalkoxylated $C_6$-$C_{22}$ fatty acids or alcohols, polyalkoxylated sorbitan esters, polyoxyalkylenated block polymers, and mixtures of such compounds.

Advantageously, the surfactant is chosen from the group formed by ethylene oxide/$C_3$-$C_{10}$ alkylene oxide block copolymers, ethoxylated and/or propoxylated distyrylphenols or tristyrylphenols, optionally polyalkoxylated fatty amines and mixtures of such compounds.

More particularly, the surfactant is an ethylene oxide/$C_3$-$C_{10}$ alkylene oxide block copolymer, especially a polyoxyethylene/polyoxypropylene block copolymer.

Such a polyoxyethylene/polyoxypropylene block copolymer may especially correspond to the structure of formula:

$$[EO]_p—[PO]_{p''}—[EO]_{p'}$$

in which:

EO is an ethylene oxide group; p and p', which are identical or different, are average numbers within a range of 2 to 1000; and PO is an optional propylene oxide group; p" is an average number within a range of 2 to 1000.

The weight ratio of the EO groups to the PO groups may especially be between 90/10 and 10/90, for example in a range of 70/30 to 40/60. The total number of EO and PO units may especially be between 20 and 500, for example in a range of 50 to 200. By way of example, use may especially be made of the surfactant Antarox® SC138 sold by Rhodia.

According to one preferred embodiment, the weight ratio of the amphiphilic compound to the solid ester particles is between 1/100 and 10/100, preferably within a range from 2.5/97.5 to 7.5/92.5.

Thus, typically the aqueous dispersion may comprise between 0.01% and 0.6%, more preferably from 0.02% to 0.3%, in particular from 0.05% to 0.25% of amphiphilic compound (% by weight).

c) Extreme Pressure Additive

According to one preferred embodiment, the aqueous dispersion comprises an "extreme pressure" type additive usually intended to further improve the lubrication under the most severe temperature conditions and to maintain a lubricating film between the wire and the die.

The extreme pressure additive is preferably water soluble. The expression "water-soluble compound" is understood to mean a compound that is soluble in an aqueous medium, at 23° C., at a concentration of 1 wt %.

The latter could optionally be of amphiphilic nature, in this case used for example as a replacement or as a supplement for the amphiphilic compound or surfactant described in the preceding paragraph b).

Although an extreme pressure additive has proved, unexpectedly, not to be essential in the aqueous dispersion used in accordance with the invention, it is believed that such an additive, particularly a phosphate ester, may however be favourable, at least in certain cases, to the dispersion of the particles and therefore to the lubrication, without however acting in accordance with a conventional extreme pressure lubrication mechanism.

Preferably, the extreme pressure additive is an extreme pressure additive based on sulphur and/or phosphorus. For example, the aqueous dispersion may comprise a combination of a non-phosphorus-containing and/or non-sulphur-containing amphiphilic compound such as a surfactant with a phosphorus-containing or sulphur-containing amphiphilic extreme pressure additive.

The extreme pressure additive is especially chosen from the group formed by optionally polyalkoxylated phosphate esters, phosphonates, sulphates, sulphides, polysulphides, and mixtures of these compounds.

More preferably, the extreme pressure additive is a phosphate ester. The phosphate ester may especially be a compound of formula:

$$(R'O)_{x'}—P(=O)(OH)_{x''},$$

in which the R' group is an optionally polyalkoxylated hydrocarbon group, x' and x" being equal to 1 or 2, on condition that the sum of x' and x" is equal to 3. The R' group may especially be a $C_1$-$C_{35}$, preferably $C_5$-$C_{30}$ (without counting the number of carbon atoms of the optional polyalkoxylates) alkyl, alkylaryl, polyalkylaryl or poly(arylalkyl)aryl group (the alkyl groups possibly being linear or branched, saturated or unsaturated); as regards the polyalkoxylated compounds, they may be polyethoxylated compounds; the degree of alkoxylation may especially be within a range of 1 to 80; preferably within a range of 1 to 15.

Preferably, the phosphate ester corresponds to the following formula:

$$[R''—(OA'')_{y'}-O]_{x'}—P(=O)(OH)_{x''}$$

a formula in which the R" groups, being identical or not, represent a hydrocarbon radical comprising 1 to 30 carbon atoms; the A" groups, being identical or not, represent a linear or branched alkylene radical comprising 2 to 4 carbon atoms, y', which is an average value, is within a range of 0 to 100, and x' and x" are equal to 1 or 2, on condition that x'+x" is equal to 2.

More particularly, R' and R" represent an aliphatic, cycloaliphatic, saturated or unsaturated, or aromatic hydrocarbon radical containing 1 to 30 carbon atoms. Preferably, the R' and R" radicals, being identical or different, are linear or branched alkyl or alkenyl radicals containing 8 to 26 carbon atoms, bearing one or more ethylenically unsaturated groups. By way of example of such radicals, mention may especially be made of the stearyl, oleyl, linoleyl and linolenyl radicals. Moreover, the R' and R" radicals, being identical or not, may be aromatic radicals bearing alkyl, arylalkyl, or alkylaryl substituents; these radicals comprise 6 to 30 carbon atoms. By way of example of such radicals, mention may be made, among others, of nonylphenyl, mono-, di- and tristyrylphenyl radicals.

More particularly, the OA" groups, being identical or different, correspond to an oxyethylenated, oxypropylenated or oxybutylenated radical, or mixtures thereof. Preferably, said group corresponds to an oxyethylenated and/or oxypropylenated radical. As regards the average value of y, it is preferably within a range of 0 to 80.

Useful extreme pressure additives are, in particular, sold by Rhodia under the names Lubrhophos® and Rhodafac®.

It is mentioned that the extreme pressure additives are preferably present in the formulation in salified, neutralized form. The neutralization may be obtained using any organic or inorganic base. It is especially possible to use organic amines, for example optionally polyalkoxylated fatty amines. More details are given below.

The amount of the extreme pressure additive in the aqueous dispersion is preferably between 0.01% and 5%, more preferably within a range of 0.1 to 2% (% by weight).

d) Other Additives

As mentioned above, the aqueous dispersion may comprise at least one base. The base is preferably water-soluble. The term "water-soluble" is understood to mean compounds that are soluble in an aqueous medium, at 23° C., at a concentration of 1 wt %. As non-limiting examples, mention may be made of hydroxides, hydroxycarbonates, carbonates or bicarbonates of an alkali metal or ammonia.

Preferably, the bases used are organic bases which are more particularly chosen from primary, secondary or tertiary polyamines or amines, comprising at least one linear, branched or cyclic hydrocarbon radical having 1 to 40 carbon atoms, optionally substituted by one or more hydroxyl radicals and/or one or more alkoxylated groups. Said alkoxylated groups are preferably ethoxylated units. Furthermore, the number of alkoxylated units, when they are present, is less than or equal to 100.

According to one preferred embodiment of the invention, when the amines have at least two amine functional groups, said functional groups are separated in pairs by a number of carbon atoms of 2 to 5. As suitable amines, mention may be made of monoethanolamine, diethanolamine, ethylenediamine, aminoethylethanolamine and aminomethylpropanolamine. Polyalkoxylated fatty amines may also be used as organic bases, such as for example those sold by Rhodia under the name Rhodamee® CS20.

The aqueous dispersion used according to the invention may comprise other compounds often usually present in aqueous lubricant compositions. These may be, for example, antifoaming additives, corrosion inhibitors, scale inhibitors, preservatives, pH modifiers, buffers, etc.

I-2. Preparation of the Aqueous Dispersion

The aqueous dispersion may be prepared by any process known by a person skilled in the art, for example by simple mixing of its various constituents.

The aqueous dispersion may also be obtained by dilution of a concentrated formulation in water. The dilution may, for example, be from 0.5 to 18 parts, preferably from 1 to 6 or 10 parts of concentrated formulation per 100 parts of water. The weight proportion of the solid particles in the concentrated formulation may be greater than 6%, preferably greater than 10%, for example from 20 to 35%.

When an extreme pressure additive is present, the concentrated formulation may comprise between 0.1 wt % and 50 wt %, preferably from 1 wt % to 20 wt %, of the extreme pressure additive. Typically, the concentrated formulation may comprise between 0.1% and 6%, preferably from 0.2% to 3%, for example from 0.5% to 2.5%, of the amphiphilic compound.

Some of the constituents or other additives may optionally be added after the dilution or during the dilution.

The concentrated formulation may be prepared, for example, from the fatty acid ester in solid form, in the form of scales, coarse powder, granules or flakes, commonly commercially available.

In order to obtain the dispersion of the particles, it is possible, in particular, to proceed either by milling, followed by a dispersion in water, or by emulsification at high temperature in the water, then cooling.

The process for preparing the concentrated formulation may especially comprise a step in which at least one part of the amphiphilic compound is mixed with the solid or liquid particles of the fatty acid ester, the particles and/or the amphiphilic compound being, where appropriate, prediluted in water.

The milling may be carried out by any known technique. Cold milling techniques are preferred, especially for limiting overheating and melting of the fatty acid ester. Cold air-jet milling operations make it possible to obtain powders, for example with a particle size centred around 15 to 20 μm. It is possible, in particular, to carry out milling using mills available from Micro-Macinazione. The powder obtained may then be slowly incorporated, with stirring (for example, blade with 4 sloped sides, 200-400 rpm) in an aqueous solution of the amphiphilic compound.

A high-temperature emulsification is particularly suitable for obtaining a fine particle size. It is thus possible to mix water (for example, around 70%) and the fatty acid ester in solid form (for example, around 30%) and to bring the mixture beyond the melting point of the ester. This may, for example, be carried out in an emulsification device having a rotor/stator type mixing system, for example the Koruma Disho 100/45 machine. The rotor speed makes it possible to control the energy engaged in the system, and to control the size of the droplets of ester formed. Once the emulsion is obtained, it is diluted in cold water until the desired concentration of ester is obtained. Solidification of the droplets then occurs, and the dispersion of solid particles is obtained. Preferably, the cooling is sudden, uncontrolled, and without a crystallization ramp. It is possible, for example, by this method to obtain particles having a size of around 0.3 μm, 1 μm or else 10 μm. The addition of the amphiphilic compound, if necessary, may be useful for providing the stability of the dispersion once cooled. It is possible to add it during the emulsification step, or afterwards.

It should be noted that a high-temperature emulsification process is not suitable for the preparation of formulations based on a wax having too high a melting point, much higher than the boiling point of water at atmospheric pressure. This is the case, for example, for aqueous compositions based on EBS (used according to the prior art).

According to particular embodiments, the dispersion and/or the concentrated formulation is substantially free of particles of straight-chain paraffin waxes, preferably of paraffin waxes in general, having a melting point greater than or equal to 71° C. or of their halogenated derivatives, associated with sulphonated castor oil and/or with a $C_4$-$C_{18}$ alkenylsuccinic acid mixture. According to more particular embodiments, the dispersion and/or the concentrated formulation is substantially free of particles of straight-chain paraffin waxes, having a melting point greater than or equal to 71° C. or of their halogenated derivatives, associated with an anionic surfactant. The expression "substantially free" is understood to mean less than 3 wt %, preferably less than 1 wt %, preferably less than 0.1 wt %, preferably less than 0.01 wt %, of paraffin wax, preferably none at all.

I-3. Use of the Lubricant Compositions in a Wet Drawing Process

As already indicated, the invention also relates to a wet drawing process for obtaining a steel wire intended for reinforcing a pneumatic tire, said process comprising the following steps:

- starting from a steel wire having a diameter greater than 0.6 mm; and
- drawing said wire through a series of dies of decreasing diameter, in the presence of a lubricant composition that is in the form of an aqueous dispersion, down to a predetermined final diameter of less than 0.5 mm, wherein said aqueous dispersion corresponds to the main definition and also to the preferred features listed previously.

Preferably, the initial steel wire has a diameter greater than 0.8 mm, for example between 0.8 and 2.0 mm. The predetermined final diameter is preferably less than 0.45 mm, for example within a range of 0.1 to 0.4 mm.

The number of dies is preferably between 10 and 40, for example in a range from 15 to 30. The degree of cross-sectional reduction per die is typically between 3% and 25%.

In a known manner, all the dies and therefore the wire itself during drawing, are immersed in a bath known as a drawing bath, apart from the last die which may, depending on the case, be immersed or be in the open air. The wire is lubricated and cooled by the drawing bath, itself cooled by water circulation coupled to a heat exchanger. The operating temperature of the bath is preferably below 40° C.

The drawing rate, that is to say the speed at the outlet of the last die (equal to the winding speed of the fine drawn wire), is preferably between 5 and 25 m/s (meters per second), for example in a range from 10 to 20 m/s.

The invention is carried out on wires made of steel, more preferably made of pearlitic (or ferritic-pearlitic) carbon steel denoted hereinafter by "carbon steel", or else made of stainless steel (by definition, steel comprising at least 11% of chromium and at least 50% of iron). But it is of course possible to use other steels.

When a carbon steel is used, its carbon content is preferably between 0.4% and 1.2%, especially between 0.5% and 1.1%. It is more preferably between 0.6% and 1.0% (wt % of steel), especially between 0.68% and 0.95%; such a content representing a good compromise between the required mechanical properties and the feasibility of the wires.

It should be noted that in the applications where the highest tensile strengths are not required, it is possible to advantageously use carbon steels whose carbon content is between 0.50% and 0.68%, and especially varies from 0.55% to 0.60%, such steels being, in the end, less expensive as they are easier to draw. Another embodiment of the invention may also consist, depending on the final intended applications, in using steels that have a low carbon content, for example between 0.2% and 0.4%, due in particular to a lower cost and a greater ease of drawing.

The invention applies to a wet drawing process for obtaining any type of Steelcord fine steel wire whether it be normal tensile (NT), high tensile (HT) or super-high tensile (SHT) such as ultra-high tensile (UHT).

The fine wires obtained by the drawing process of the invention may have a tensile strength (denoted by $R_m$) which is preferably greater than 2000 MPa, for example between 2000 and 4000 MPa, more preferably greater than 2800 MPa, for example between 2800 MPa and 4500 MPa. A person skilled in the art knows how to produce steel wires having such a strength, in particular by adjusting the carbon content of the steel and/or the degrees of work-hardening of these wires.

The steel used, which is, for example, a carbon steel or a stainless steel, may be a steel known as "clear" (that is to say, not coated) steel or be coated with a metal layer improving, for example, the processing properties of the steel wire, its usage properties or even those of any cable or tire for which it is intended, such as, for example, the properties of adhesion, corrosion resistance or else ageing resistance.

According to one preferred embodiment, the steel used is covered with zinc or a zinc alloy, in particular brass (Zn—Cu alloy); it is recalled that during the wire drawing process, the brass or zinc coating is well known for facilitating the drawing of the wire and also the bonding of the wire with the rubber. However the wires could be covered with a thin metal layer other than a brass or zinc layer, or even a second layer used in addition to the first, having, for example, the role of improving the corrosion resistance of these wires and/or their adhesion to rubber, for example a thin layer of Co, Ni, Al or an alloy of two or more of the compounds Cu, Zn, Al, Ni, Co and Sn.

I-4. Use of the Fine Drawn Wires for Manufacturing a Pneumatic Tire

The Steelcord steel wires obtained by the drawing process of the invention may then be assembled, for example cabled or twisted together, or even used as is in order to form metallic reinforcing elements (or "reinforcements") which are intended for manufacturing and reinforcing pneumatic tires for motor vehicles.

Thus, another subject of the present invention is a process for manufacturing a pneumatic tire comprising rubber and at least one steel reinforcing element, said process comprising the following steps:

- starting from a steel wire having a diameter greater than 0.6 mm;
- drawing said wire through a series of dies of decreasing diameter, in the presence of a lubricant composition that is in the form of an aqueous dispersion as defined previously, until a fine wire having a diameter of less than 0.5 mm is obtained;
- optionally assembling a plurality of fine wires thus obtained in order to obtain an assembly of fine wires;
- incorporating said fine wire and/or said assembly as a metallic reinforcing element, as is or incorporated beforehand into the rubber in the uncured state, into the structure of a pneumatic tire in the process of being manufactured;
- carrying out the curing of the pneumatic tire once its structure is completed.

Preferably, a carbon steel is used, its carbon content preferably being between 0.4% and 1.2%, in particular between 0.5% and 1.1%. Preferably, the initial steel wire has a diameter greater than 0.8 mm, for example within a range of 0.8 to 2.0 min. The predetermined final diameter is preferably less than 0.45 mm, for example within a range of 0.1 to 0.4 mm. The number of dies is preferably between 10 and 40, for example within a range from 15 to 30. The degree of cross-sectional reduction per die is typically between 3% and 25%. The drawing rate is preferably between 5 and 25 m/s, for example within a range of 10 to 20 m/s. The fine wires obtained by drawing, before assembly, have a tensile strength $R_m$ which is preferably greater than 2000 MPa, for example between 2000 and 4000 MPa, more preferably greater than 2800 MPa, for example between 2800 MPa and 4500 MPa.

The optional step of assembling the individual fine wires exiting the drawing operation, in line or not with the latter, is typically a cabling operation (that is to say without notable torsion of the individual wires) or a twisting operation (that is to say with torsion on the individual wires) with a view to obtaining what is customarily referred to as a steel cord. During the assembling operation, gum (rubber composition) in the uncured state may optionally be incorporated into the internal structure of the assembly of fine wires, during the operation itself for assembling the wires (by the technique known as "in situ rubber coating") or just after said operation.

The fine drawn wires or the cords (for example layered cords or strand cords) may be "rubber coated" individually (that is to say sheathed with a rubber composition) or else "calendered", that is to say pressed between two rolls between two thin films of rubber composition; the cords then become calendered plies. These rubber-coated wires or cords or calendered plies (for the latter, generally cut to width of suitable dimensions) are intended for all or part of the tire, for example its crown (especially its belt) and/or its carcass reinforcement and/or its bead zone.

The rubber used is preferably a diene elastomer chosen more preferably from the group formed by polybutadienes (BRs), natural rubber (NR), synthetic polyisoprenes (IRs), various copolymers of butadiene, various copolymers of isoprene, and blends of these elastomers. One more preferable embodiment consists in using an "isoprene" elastomer, that is to say a homopolymer or copolymer of isoprene, in other words a diene elastomer chosen from the group formed by natural rubber (NR), synthetic polyisoprenes (IRs), various copolymers of isoprene and blends of these elastomers.

The rubber composition is preferably of the vulcanizable type, that is to say that it comprises a system known as a vulcanization system, that is to say based on sulphur (or on a sulphur-donating agent) and on various vulcanization accelerators or activators. It may also comprise all or some of the additives customarily used in the rubber matrices intended for manufacturing tires, such as for example reinforcing fillers, antiageing agents, antioxidants, plasticizers or extender oils, processing aids, antireversion agents, reinforcing resins, known adhesion-promoting systems of the metal salt type, for example cobalt or nickel salts in particular.

Once the structure (or construction) of the tire is finished, the latter in the uncured state (that is to say still comprising the rubber in the uncured state), is subjected in a known manner to a final curing (crosslinking or vulcanization) operation, generally in a mould under a high pressure under high temperature (for example at 150° C. for about ten minutes).

II. EXEMPLARY EMBODIMENTS OF THE INVENTION

II-1. Preparation of the Aqueous Dispersions (Concentrated Formulations)

a) Raw Materials Used:

- EGDS: Alkamuls® EGDS from Rhodia; EGDS flakes at more than 98 wt %;
- EBS: WAXSO MK grade, micronized with a median diameter of 15 μm from Sogis Industria Chimica Spa;
- Paraffin wax: Sigma Aldrich product under No. 327204; linear saturated hydrocarbons with a melting point of around 55° C.;
- SC138: Antarox® SC138 from Rhodia; polyoxyethylene/polyoxypropylene block copolymer (solid);
- S40: Soprophor® S40 from Rhodia; ethoxylated tristyrylphenol (solid);
- DSS7: Soprophor® DSS7 from Rhodia; sulphated ethoxylated distyrylphenol (viscous paste);
- CS20: Rhodameen® CS20 from Rhodia; ethoxylated fatty amine (liquid); and
- EP: ethoxylated $C_{12}$-$C_{18}$ phosphate ester from the Rhodafac® range of products from Rhodia.

The experimental concentrated formulations, corresponding to the aqueous dispersions in dilute form C-2 to C-13 used in the drawing tests which follow, are given in Table 1 below (concentrations in wt % of dry matter).

TABLE 1

| Composition | Wax | Surfactant | EP | Preparation procedure | Particle size |
|---|---|---|---|---|---|
| C-2 | EBS - 10% | SC138 - 0.5% | / | Procedure 1 | 15 μm |
| C-3 | Paraffin - 10% | SC138 - 0.5% | / | Procedure 2 | 5 μm |
| C-4 | EGDS - 10% | SC138 - 0.5% | / | Procedure 3 | 15 μm |
| C-5 | EBS - 10% | SC138 - 0.5% | 0.5% | Procedure 1 | 15 μm |
| C-6 | Paraffin - 10% | SC138 - 0.5% | 0.5% | Procedure 2 | 5 μm |
| C-7 | EGDS - 10% | SC138 - 0.5% | 0.5% | Procedure 3 | 15 μm |
| C-8 | EGDS - 10% | S40 - 0.5% | / | Procedure 3 | 15 μm |
| C-9 | EGDS - 10% | DSS7 - 0.5% | / | Procedure 3 | 15 μm |
| C-10 | EGDS - 10% | CS20 - 0.5% | / | Procedure 3 | 15 μm |
| C-11 | EBS - 10% | S40 - 0.5% | / | Procedure 1 | 15 μm |
| C-12 | EBS - 10% | DSS7 - 0.5% | / | Procedure 1 | 15 μm |
| C-13 | EBS - 10% | CS20 - 0.5% | / | Procedure 1 | 15 μm |

b) Preparation Procedures:

All the formulations were at pH 8-9. At the end of the procedure, the pH was adjusted, if necessary, using diethanolamine or phosphoric acid.

The particle sizes indicated were measured on a Horiba LA-910 (light-scattering) machine, with a relative optical index of the dispersed particles: 1.07-0.00i. The measurement was an average by volume (that is to say by weight) over the particle size distribution.

The concentrated formulations prepared were 60 kg (total weight) including:

- 10 wt % of dispersed solid particles;
- 5 wt % of surfactant relative to the solid particles, i.e. 0.5% surfactant relative to the total concentrated formulation; and
- when a phosphate ester was added (C-5, C-6 and C-7): 5 wt % of EP relative to the dispersed particles, i.e. 0.5% of EP relative to the total concentrated formulation.

Procedure 1

An aqueous solution of surfactant was prepared, then EBS was introduced into the aqueous solution, with moderate stirring (Rayneri type stirrer motor, 200 rpm). When an extreme pressure additive was used, this was added last in the form of a concentrated aqueous solution, the pH of which was adjusted between 8 and 9 by addition of diethanolamine, with moderate stirring (Rayneri motor, 200 rpm). All the operations were carried out at ambient temperature (23° C.).

Procedure 2

An aqueous solution of surfactant was prepared which was brought to a temperature of 10° C. above the melting point of the wax used. Next, with stirring/milling, the molten wax (at a temperature of 10° C. above the melting point of the wax used) was introduced into the surfactant solution. This operation was carried out in a Koruma Disho 100/45 machine. The size of the emulsion formed depended on the surfactant concentration, on the speed (1000 to 3000 rpm) and on the milling time. The wax composition of this emulsion was 30%. The size of the molten wax droplets could be adjusted between around 0.2 μm and 10 μm.

The emulsion was then diluted by a factor of three in cold water (5° C.), simultaneously ensuring the quenching of the emulsion (and the solidification of the wax droplets) and the dilution to a concentration of 10% of wax. Depending on the amount of surfactant used for producing the emulsion, surfactant was added to the dilution water in order to have a correct total surfactant composition. This operation was carried out in a water-cooled chamber, with moderate stirring (Rayneri motor, 200 rpm).

When an extreme pressure additive was used, this was added last in the form of a concentrated aqueous solution, the pH of which was adjusted between 8 and 9 by addition of diethanolamine, with moderate stirring (Rayneri motor, 200 rpm).

Procedure 3

The EGDS flakes were milled using an air-jet mill at 0° C. from Micro-Macinazione. The milling energy (pressure and air flow rate) and the flow rate of EGDS were controlled so as to obtain the particle size indicated. EGDS particles were obtained having a size between 10 and 15 μm.

An aqueous solution of surfactant was prepared, then the EGDS particles were introduced into the aqueous solution, with moderate stirring (Rayneri motor, 200 rpm). When an extreme pressure additive was used, this was added last in the form of a concentrated aqueous solution, the pH of which was adjusted between 8 and 9 by addition of diethanolamine, with moderate stirring (Rayneri motor, 200 rpm). The mixing operations were carried out at ambient temperature (23° C.).

II-2 Drawing Tests

The exemplary embodiments which follow demonstrate that, in comparison to known solutions that also use aqueous dispersions as lubricant compositions, the use according to the invention unexpectedly results in a superior compromise of properties, even in the presence of a lubricant composition of particularly simple formulation.

In these examples, fine Steelcord wires made of carbon steel (NT type) coated with brass were produced by wet drawing.

Apart from the formulation of the drawing lubricant, these wires were prepared in a known manner, for example starting from wire rods (diameter 5 to 6 mm) made of carbon steel (carbon content of about 0.7%) that were first work-hardened by (dry) drawing, down to an intermediate diameter in the vicinity of 1.5 mm and a strength of around 1100 MPa.

After heat treatment, then deposition of a brass coating (for example containing 64% of copper) on these intermediate wires, work hardening known as "final" work hardening was carried out on each wire by cold drawing in a wet medium, through a series of dies (about twenty in total) whose diameter gradually decreased (degree of cross-sectional reduction per die between 3% and 25%) in order to obtain a final diameter of 0.28 mm.

The drawing lubricant composition, in which, in a known manner, the dies and the wire being formed were immersed, was in all the examples in the form of an aqueous dispersion, one of them referred to as a "commercial" composition and several others being experimental compositions, the latter being in accordance or not with the invention.

The lubricant composition referred to as a commercial composition was produced from a Supersol® 4419T concentrated aqueous formulation available from Rhodia, comprising EBS-based particles. It was used as a control. For reasons of simplicity it is referred to as "commercial formulation" or "commercial lubricant". Besides the EBS particles, this concentrated commercial formulation comprises various common additives, in particular a surfactant and an extreme pressure additive of the phosphate ester type.

The other experimental dispersions tested comprised, at a concentration of 1 wt %, solid particles of the following compounds (waxes):

EGDS (ethylene glycol distearate);

EBS (ethylene bis-stearamide); and paraffin wax.

As explained in detail hereinbelow, these aqueous dispersions were stabilized by various known commercial surfactants, they could contain, in certain cases, an extreme pressure additive of the phosphate ester type.

The experimental dispersions were prepared by dilution (to a concentration of solid particles of 1 wt %), in water, of experimental concentrated formulations, for which details of the compositions and of the preparation were given in the preceding paragraph.

For comparison, the formulae of EGDS and of EBS are stated below:

(EGDS) $H_3C—(CH_2)_{16}—CO—O—CH_2—CH_2—O—CO—(CH_2)_{16}—CH_3$ (EBS) $H_3C—(CH_2)_{16}—CO—HN—CH_2—CH_2—NH—CO—(CH_2)_{16}—CH_3$

The lubrication performance in the wet drawing machine was characterized by two parameters:

- the loss of brass (expressed as a percentage of the mass of brass initially deposited) was measured by the difference between the mass deposited on the wire of intermediate diameter and the mass measured on the final fine wire (at the outlet of the last die); it is considered that a loss of brass below 10% is the indicator of good quality lubrication; and
- the die wear was characterized indirectly, by measuring the increase in the diameter of the wire at the end of 30 kg of fine wire drawn to the initially targeted theoretical diameter.

An effective lubrication can also be characterized by a low friction coefficient, for example a low friction coefficient determined by tribological techniques, especially in a contact of EHD (elastohydrodynamic) type. An effective lubrication can also be characterized by low wear; for example determined by mass balances carried out during tribological studies, especially in a contact of EHD type or of Falex type.

The fine wire obtained was also characterized by tensile testing in order to measure its maximum tensile strength, denoted by $R_m$ (measured according to the ISO 6892 standard from 1984, from the force/elongation curve of the wire tested).

a) Test 1

In this first test, three experimental waxes (EBS, paraffin wax and EGDS), all three stabilized by one and the same known surfactant (Antarox® SC138 sold by Rhodia) (compositions respectively denoted by C-2 to C-4), were compared to the aforementioned EBS-based commercial lubricant Supersol® 4419T (composition denoted by C-1).

Only the use of the composition C-4 was therefore according to the invention.

Table 2 below summarizes the drawing results obtained with these four lubricant compositions.

TABLE 2

| Lubricant: | Wear (μm per 30 kg) | $R_m$ (MPa) | Brass loss (%) |
|---|---|---|---|
| C-1 (control) | 0 | 2950 | 9 |
| C-2 (EBS) | Non-drawable wire | — | — |
| C-3 (paraffin) | Non-drawable wire | — | — |
| C-4 (EGDS) | 0 | 2910 | 3 |

Firstly, a comparison of the experimental compositions C-2, C-3 and C-4 clearly reveals the superiority of the EGDS wax compared to the two other waxes, since in these very simplified formulations, only the composition C-4 proves capable of drawing a significant length of steel wire; with the two other compositions C-2 and C-3, it was quite simply impossible to draw (breaking of the wire even before reaching the nominal drawing speed).

Unexpectedly, the composition C-4 reveals an excellent lubricating ability as results are obtained, despite a formulation which could not be simpler (combination of a wax and a surfactant), which are equivalent in terms of wear to those of the commercial lubricant (control C-1) which is itself entirely formulated, and which are even improved as regards the loss of brass.

It is deduced therefrom that, in particular, contrary to that which was commonly acknowledged by a person skilled in the art until now, the use of an extreme pressure type additive is not necessarily essential for drawing steel wire of Steelcord type; this is indeed the case for the aqueous dispersion used according to the invention.

b) Test 2

In this test, the preceding test 1 was reproduced but this time adding, in addition to the surfactant (Antarox® SC138), an extreme pressure additive of the ethoxylated $C_{12}$-$C_{18}$ phosphate ester type from the Rhodafac® range of products sold by Rhodia. The commercial lubricant (composition C-1) being already formulated with a phosphate ester additive, no other additive was added to it.

Only the use of the composition C-7 was according to the invention.

Table 3 below summarizes the drawing results obtained with these four lubricant compositions.

TABLE 3

| Lubricant: | Wear (μm/30 kg) | $R_m$ (MPa) | Brass loss (%) |
|---|---|---|---|
| C-1 (control) | 0 | 2950 | 9 |
| C-5 (EBS) | 0 | 2825 | 5.8 |
| C-6 (paraffin) | >10 | 2835 | 4 |
| C-7 (EGDS) | 0 | 2835 | 5.4 |

Compared to the preceding Table 2, this Table 3 demonstrates that although the extreme pressure additive renders some of the experimental formulations (C-5 and C-6) based on paraffin wax and especially on EBS capable of being drawn, this additive does not, on the other hand, provide any visible improvement to the composition used according to the invention (compare composition C-7 to composition C-4 from the preceding test 1).

In other words, the composition C-7 according to the invention, based on EGDS, proves insensitive to the presence or absence of the extreme pressure additive for good die lubrication. This constitutes another remarkable and unexpected result for a person skilled in the art.

c) Test 3

In this test, the preceding EGDS and EBS waxes were again compared, this time in the presence of four different surfactants (all sold by Rhodia), all comprising at least one polyoxyethylene block as a hydrophilic unit and various hydrophobic units:

- a non-ionic surfactant (Antarox® SC 138, solid) of the polyoxyethylene/polyoxypropylene block copolymer type;
- a non-ionic surfactant (Soprophor® S 40, solid) of the ethoxylated tristyrylphenol type comprising tristytylphenol as a hydrophobic unit;
- an anionic surfactant (Soprophor® DSS7, viscous paste) of the sulphated ethoxylated distyrylphenol type comprising distyrylphenol as a hydrophobic unit; and
- a surfactant (Rhodameen® CS 20, liquid) of the ethoxylated fatty amine type comprising an aliphatic chain as a hydrophobic unit.

No other additive, in particular extreme pressure additive, was used in the experimental compositions tested. Only the compositions C-4 and C-8 to C-10 were in accordance with the invention. The compositions C-2 and C-4 had already been tested in the preceding test 1.

Table 4 below summarizes the drawing results obtained with these eight lubricant compositions.

TABLE 4

| Lubricant: | Wear (μm/30 kg) | $R_m$ (MPa) | Brass loss (%) |
|---|---|---|---|
| C-4 (EGDS + SC138) | 0 | 2930 | 3 |
| C-8 (EGDS + S40) | 4 | 2960 | 5.2 |
| C-9 (EGDS + DSS7) | 0.5 | 2880 | 4.5 |
| C-10 (EGDS + CS20) | 1.5 | 2895 | 5.2 |
| C-2 (EBS + SC138) | Non-drawable wire | — | — |
| C-11 (EBS + S40) | Non-drawable wire | — | — |
| C-12 (EBS + DSS7) | Non-drawable wire | — | — |
| C-13 (EBS + CS20) | >10 | * | * |

* not measured (wire obtained outside of tolerances)

The results from this Table 4 clearly confirm the better performance of the EGDS wax in comparison to the EBS wax, this being irrespective of the surfactant which is associated therewith.

Moreover, it is noted that the compositions C-4, C-9 and C-10 (in accordance with the invention) give an excellent performance from an industrial viewpoint, with a degree of die wear below 2 μm combined with a loss of brass below 10%. The best lubricant composition (C-4) is that based on EGDS and on the polyoxyethylene/polyoxypropylene block copolymer.

For EBS, irrespective of the surfactant used, the performance is either unacceptable, or mediocre (composition C-13).

Other wire-drawing tests, in accordance and not in accordance with the invention, have been carried out starting from an intermediate steel wire having a higher carbon content (0.9%), with a diameter in the vicinity of 1.3 mm (strength $R_m$ equal to around 1200 MPa), for obtaining SHT type wires with a final diameter of 0.23 mm. The results obtained wholeheartedly confirmed the results of the tests 1 to 3 described previously.

The invention claimed is:

1. A process for the wet drawing of a steel wire intended for reinforcing a pneumatic tire, said process comprising the steps of:

starting from a steel wire having a diameter greater than 0.6 mm; and drawing said wire through a series of dies of decreasing diameter, in the presence of a lubricant composition that is in the form of an aqueous dispersion, down to a predetermined final diameter of less than 0.5 mm, wherein said aqueous dispersion comprises solid particles of an ester of a fatty acid comprising from 5 to 40 carbon atoms, wherein the fatty acid ester corresponds to the formula:

$$[R—COO—]_x—A—[OH]_y \quad (I)$$

in which R is a linear or branched, saturated or unsaturated hydrocarbon group, A is a hydrocarbon group, optionally interrupted by one or more heteroatoms, of valency x+y, x is an average number from 1 to 5, y is an average number from 0 to 5, and x+y varies from 1 to 10;

wherein the ester is a diester corresponding to the formula:

$$R^1—CO—O—A—O—CO—R^2 \quad (II)$$

in which $R^1$ and $R^2$, which are identical or different, are linear or branched, saturated or unsaturated hydrocarbon groups comprising from 4 to 39 carbon atoms; and wherein $R^1$ and $R^2$ comprise from 13 to 21 carbon atoms.

2. The process according to claim 1, wherein the fatty acid comprises from 6 to 24 carbon atoms,

3. The process according to claim 2, wherein the fatty acid comprises from 14 to 22 carbon atoms.

4. The process according to claim 1, wherein the fatty acid ester derives from a diol or from a polyol.

5. The process according to claim 1, wherein $R^1$ and $R^2$ comprise from 15 to 21 carbon atoms.

6. The process according to claim 1, wherein the divalent group A corresponds to the formula:

$$—(CH_2)_z—[EO]_m—[PO]_m—(CH_2)_{z'}—$$

in which:

z and z', which are identical or different, are integers from 1 to 10;

EO is an optional ethylene oxide group;

PO is an optional propylene oxide group;

m and m', which are identical or different, are average numbers within a range from 0 to 100.

7. The process according to claim 1, wherein the diester corresponds to the formula:

$$R^1—CO—O—(CH_2)_{z''}—O—CO—R^2 \quad (III)$$

in which z" is an integer from 1 to 10.

8. The process according to claim 1, wherein the diester corresponds to the formula:

$$H_3C—(CH_2)_n—CO—O—(CH_2)_{z''}—O—CO—(CH_2)_{n'}—CH_3 \quad (IV)$$

in which:

z" is an integer from 1 to 4;

n and n', which are identical or different, are integers from 14 to 20.

9. The process according to claim 1, wherein A is an alkylene chosen from the group formed by methylene, ethylene, propylene and butylene groups and mixtures of these groups.

10. The process according to claim 8, wherein the diester is the ethylene glycol distearate of formula:

$$H_3C—(CH_2)_{16}—CO—O—(CH_2)_2—O—CO—(CH_2)_{16}—CH_3 \quad (V).$$

11. The process according to claim 1, wherein the aqueous dispersion comprises between 0.05 and 6% of ester particles (% by weight).

12. The process according to claim 1, wherein the ester particles have a particle size distribution with at least 90 wt % of the particles having a size between 0.1 and 50 μm.

13. The process according to claim 1, wherein the aqueous dispersion further comprises an amphiphilic compound.

14. The process according to claim 13, wherein the amphiphilic compound is a surfactant.

15. The process according to claim 14, wherein the surfactant is chosen from the group formed by anionic, cationic, amphoteric, zwitterionic and non-ionic surfactants and mixtures of such surfactants.

16. The process according to claim 15, wherein the surfactant is a non-ionic surfactant.

17. The process according to claim 16, wherein the non-ionic surfactant is chosen from the group formed by polyalkoxylated phenols, optionally polyalkoxylated $C_6$-$C_{22}$ fatty acids or alcohols, polyalkoxylated sorbitan esters, polyoxyalkylenated block polymers and mixtures of such compounds.

18. The process according to claim 17, wherein the surfactant is chosen from the group formed by ethylene oxide/$C_3$-$C_{10}$ alkylene oxide block copolymers, ethoxylated or propoxylated di- or tri-styrylphenols, fatty amines and mixtures of such compounds.

19. The process according to claim 18, wherein the surfactant is an ethylene oxide/$C_3$-$C_{10}$ alkylene oxide block copolymer.

20. The process according to claim 19, wherein the surfactant is a polyoxyethylene/polyoxypropylene block copolymer.

21. The process according to claim 20, wherein the block copolymer is a copolymer of structure $[EO]_p$—$[PO]_{p''}$—$[EO]_{p'}$, where:

EO is an ethylene oxide group; p and p', which are identical or different, are average numbers within a range from 2 to 1000; and PO is an optional propylene oxide group; p" is an average number within a range from 2 to 1000.

22. The process according to claim 13, wherein the weight ratio of the amphiphilic compound to the ester particles is between 1/100 and 10/100.

23. The process according to claim 1, wherein the aqueous dispersion further comprises an extreme pressure additive.

24. The process according to claim 23, wherein the extreme pressure additiveis chosen from the group formed by phosphate esters, phosphonates, sulphates, (poly)sulphides and mixtures of these compounds.

25. The process according to claim 24, wherein the extreme pressure additive is a phosphate ester.

26. The process according to claim 23, wherein the aqueous dispersion comprises between 0.01% and 5% of the extreme pressure additive (% by weight).

* * * * *